US007012584B2

(12) United States Patent
Muruyama et al.

(10) Patent No.: US 7,012,584 B2
(45) Date of Patent: Mar. 14, 2006

(54) ORGANIC EL PANEL DRIVE CIRCUIT

(75) Inventors: Junichi Muruyama, Niigata (JP); Akira Suzuki, Niigata (JP)

(73) Assignee: Nippon Seiki Co., Ltd., Niigata (JP)

( * ) Notice: Subject to any disclaimer, the term of this patent is extended or adjusted under 35 U.S.C. 154(b) by 438 days.

(21) Appl. No.: 10/250,787

(22) PCT Filed: Aug. 22, 2002

(86) PCT No.: PCT/JP02/08484

§ 371 (c)(1),
(2), (4) Date: Jul. 9, 2003

(87) PCT Pub. No.: WO03/042965

PCT Pub. Date: May 22, 2003

(65) Prior Publication Data

US 2004/0061670 A1 Apr. 1, 2004

(30) Foreign Application Priority Data

Nov. 16, 2001 (JP) ..... 2001-350872

(51) Int. Cl.
*G09G 3/30* (2006.01)

(52) U.S. Cl. ..... 345/76; 345/82; 345/97; 345/101; 345/590; 349/72; 349/199; 315/169.3

(58) Field of Classification Search ..... 345/76, 345/82, 97, 101, 590; 349/72, 199; 315/169.3
See application file for complete search history.

(56) References Cited

U.S. PATENT DOCUMENTS 5,754,154 A * 5/1998 Katakura et al. ..... 345/97
5,960,381 A * 9/1999 Singers et al. ..... 702/183
6,320,568 B1 * 11/2001 Zavracky ..... 345/101
6,479,940 B1 * 11/2002 Ishizuka ..... 315/169.3
6,496,177 B1 * 12/2002 Burton ..... 345/101
6,593,934 B1 * 7/2003 Liaw et al. ..... 345/590

FOREIGN PATENT DOCUMENTS

JP 11-305729 11/1999
JP P2000-214824 A 8/2000
JP P2001-142432 A 5/2001

* cited by examiner

*Primary Examiner*—Sumati Lefkowitz
*Assistant Examiner*—Tammy Pham
(74) *Attorney, Agent, or Firm*—McDermott Will & Emery LLP

(57) ABSTRACT

Drive switches 3*b*1 to 3*bn* selectively apply a constant current to any one of anode electrode lines 1A. Constant current sources 3*a*1 to 3*an* supply the constant current to anode electrode lines 1A, respectively, via drive switches 3*b*1 to 3*bn*. Scanning switches 2*a*1 to 2*am* selectively set any one of cathode electrode lines 1B to a ground potential and apply a reverse bias voltage to the other cathode electrode lines 1B. First temperature compensation means 5 is provided with the temperature detection means 5*a* for detecting an ambient temperature of organic EL devices E11 to Enm, and generates a first temperature compensation drive voltage VA obtained by changing a power supply voltage according to an output from the temperature detection means 5*a* and supplies the first temperature compensation drive voltage VA to the constant current sources 3*a*1 to 3*an*. Second temperature compensation means 6 applies a temperature-compensated second temperature compensation drive voltage VB, which is generated based upon the first temperature compensation drive voltage VA outputted from the first temperature compensation means 5, to the cathode electrode lines 1B as the reverse bias voltage via the scanning switches 2*a*1 to 2*am*.

5 Claims, 4 Drawing Sheets

4 : CONTROL UNIT
5 : FIRST TEMPERATURE COMPENSATION MEANS
5a : TEMPERATURE DETECTION MEANS
5b : POWER SUPPLY CIRCUIT
6 : SECOND TEMPERATURE COMPENSATION MEANS

4 : CONTROL UNIT
5 : FIRST TEMPERATURE COMPENSATION MEANS
5a : TEMPERATURE DETECTION MEANS
5b : POWER SUPPLY CIRCUIT
6 : SECOND TEMPERATURE COMPENSATION MEANS

4 : CONTROL UNIT

ORGANIC EL PANEL DRIVE CIRCUIT

TECHNICAL FIELD

The present invention relates to a drive circuit for an organic EL panel provided with organic EL devices of a dot matrix type.

BACKGROUND ART

As an organic EL panel provided with organic EL devices serving as constant current drive devices, there is, for example, one described in JP-A-2001-142432. This is an organic EL panel of a dot matrix type in which plural anode electrode lines using a conductive transparent film such as an ITO (Indium Tin Oxide) are formed in parallel with each other on a translucent insulating support substrate such as a glass substrate, an organic layer (organic EL layer) is formed on the back of these anode electrode lines, plural parallel cathode electrode lines using a metal evaporated film such as aluminum is formed on the back of this organic layer so as to be perpendicular to the anode electrode lines, and the organic layer is held by these anode electrode lines and cathode electrode lines. The organic EL panel has been attracting attentions as a display, which is capable of realizing low power consumption, high display quality, and reduced thickness, substituting a liquid crystal display.

As a drive circuit for such an organic EL panel, there is one shown in FIG. 6. Such a drive circuit includes an organic EL panel 1, a cathode side drive circuit 2, an anode side drive circuit 3, and a control unit 4.

The organic EL panel 1 is formed by disposing organic EL devices E11 to Enm bearing pixels in a lattice shape. In a structure of these organic EL devices E11 to Enm, an organic layer including at least a light-emitting layer is held in crossing parts of plural anode electrode lines 1A, which are provided so as to be laid along a vertical direction, and plural cathode electrode lines 1B, which are provided so as to be perpendicular to the anode electrode lines 1A. If represented as an equivalent circuit, the organic EL devices E11 to Enm are formed with one ends thereof connected to the anode electrode lines 1A (anode side of a diode component) and the other ends connected to the cathode electrode lines 1B (cathode side of a diode component).

The cathode side drive circuit 2 is provided with plural scanning switches 2*a*1 to 2*am* corresponding to the respective cathode electrode lines 1B and selects a reverse bias voltage Vb, which becomes a power supply voltage on the cathode side in the respective organic EL devices E11 to Enm, or a ground potential (0V) with the scanning switches 2*a*1 to 2*am* based upon a control signal of the control unit 4. That is, the organic EL devices E11 to Enm come into a non-light emitting state when the reverse bias voltage Vb is selected by the scanning switches 2*a*1 to 2*am* and come into a light emitting state when the ground potential is selected by the scanning switches 2*a*1 to 2*am*.

The anode side drive circuit 3 is provided with constant current sources 3*a*1 to 3*an*, which supply a constant current (drive current) to the anode electrode lines 1A, respectively, in association with them, and is constituted such that the constant current from these constant current sources 3*a*1 to 3*an* is supplied to the respective anode electrode lines 1A via the respective drive switches 3*b*1 to 3*bn*. Changeover of the respective drive switches 3*b*1 to 3*bn* is determined based upon a control signal from the control unit 4.

The control unit 4 includes a microcomputer and, for example, when travel information of a vehicle is inputted from various sensors, in an attempt to perform predetermined arithmetic operation processing and to display various kinds of information such as a vehicle speed, an engine speed, and residual fuel on the organic EL panel 1, outputs the travel information to the cathode side drive circuit 2 and the anode side drive circuit 3, respectively, as a control signal, and selectively turns ON/OFF the scanning switches 2*a*1 to 2*am* and the drive switches 3*b*1 to 3*bn* corresponding to the cathode electrode and anode electrode lines 1B, 1A necessary for causing the organic EL devices E11 to Enm to emit light, thereby causing the organic EL panel 1 to display predetermined information. The drive circuit of the organic EL panel comprises the above portions.

In such a drive circuit of the organic EL panel 1, gradation control is performed which is based upon pulse width modulation (PWM) of the cathode and anode scanning lines 1B, 1A corresponding to the scanning switches 2*a*1 to 2*am* and the drive switches 3*b*1 to 3*bn* in the cathode side drive circuit 2 and the anode side drive circuit 3, and the organic EL devices E11 to Enm bearing pixels are driven by the reverse bias voltage (output voltage) Vb, which is a non-selected/selected voltage in the cathode side drive circuit 2, and an output current from the constant current sources 3*a*1 to 3*an* in the anode side drive circuit 3.

However, in the organic EL devices E11 to Enm which have temperature dependency making it possible to emit light with a smaller drive voltage as temperature rises, in order to eliminate reactive power consumed in the anode side drive circuit 3, the organic EL devices E11 to Enm have to be controlled such that a drive voltage is reduced as an ambient temperature rises and that the drive voltage is increased as the ambient temperature falls.

In addition, there is a problem as described below. If the reverse bias voltage Vb in the cathode side drive circuit 2 suitable for the ambient temperature is not given to the organic EL devices E11 to Enm, in gradation control for one scanning line (light intensity control for one period based upon PWM) in the organic EL device E11 to Enm emitting light by the reverse bias voltage (output voltage) Vb and the output voltage of the constant current sources 3*a*1 to 3*an*, the reverse bias voltage Vb on the cathode side becomes larger than a light emission start voltage (drive voltage of an organic EL device suitable for an ambient temperature) in the organic EL devices E11 to Enm. When the reverse bias voltage Vb is selected by the scanning switches 2*a*1 to 2*am* in the cathode side drive circuit 2 in this state, in an organic EL device coupled to the selected cathode electrode line 1B, a charging current is generated by a capacitor component included in the organic EL device. Thus, the reverse bias voltage Vb reaches a light emission voltage concurrently with sharp rising, and light exceeding a predetermined luminance is emitted, although this occurs only in an instance. Note that, although influence of the light emission luminance exceeding the predetermined luminance in the organic EL devices E11 to Enm is relatively inconspicuous if a current application time from the constant current sources 3*a*1 to 3*an* by the gradation control is long, the influence becomes more conspicuous as the current application time is shortened by the gradation control.

The present invention has been devised in view of the above-mentioned problem and provides a drive circuit for an organic EL panel capable of controlling generation of reactive power even in the case in which an ambient temperature changes and, at the same time, keeping a light emission luminance of an organic EL device bearing pixels constant.

DISCLOSURE OF THE INVENTION

The present invention is a drive circuit for an organic EL panel which is provided with first and second electrode lines, at least one of which is translucent, in a plural form, respectively, and in which an organic layer including at least a light-emitting layer is held between the respective electrode lines to constitute an organic EL devices of a dot matrix shape, the drive circuit for an organic EL panel comprising: anode scanning means for selectively applying a constant current to any one of the first electrode lines; a constant current source which supplies the constant current to the first electrode lines, respectively, via the anode scanning means; cathode scanning means for selectively setting any one of the second electrode lines to a ground potential and applying a reverse bias voltage to the other second electrode lines; first temperature compensation means which is provided with temperature detection means for detecting an ambient temperature of the organic EL devices, and generates a first temperature compensation drive voltage obtained by changing a power supply voltage according to an output from the temperature detection means and supplies the first temperature compensation drive voltage to the constant current source; and second temperature compensation means which applies a temperature-compensated second temperature compensation drive voltage, which is generated based upon the first temperature compensation drive voltage outputted from the first temperature compensation means, to the second electrode lines as the reverse bias voltage via the cathode scanning means.

The second temperature compensation means generates the second temperature compensation drive voltage which has a predetermined offset amount with respect to the first temperature compensation drive voltage obtained by the first temperature compensation means and determines the offset amount with offset means which is formed by connecting a Zener diode and a resister in series.

In addition, the second temperature compensation means applies the second temperature compensation voltage of a predetermined ratio with respect to the first temperature compensation drive voltage obtained by the first temperature compensation means to the second electrode lines via the cathode scanning means and generates the second temperature compensation drive voltage divided at a predetermined ratio with respect to the first temperature compensation drive voltage by voltage dividing means formed by connecting at least two registers in series.

Therefore, in the cathode side in the organic EL panel, since it becomes possible to give a second temperature compensation drive voltage, which becomes a proper drive voltage according to an ambient temperature, to the cathode electrode means, it becomes possible to suppress generation of a light emission luminance exceeding a predetermined luminance as in the past. Thus, it becomes possible to suppress a change in luminance with respect to temperature change of organic EL devices bearing pixels, and it is possible to obtain satisfactory display on an organic EL panel and marketability can be improved.

BEST MODE FOR CARRYING OUT THE INVENTION

Figure 1:
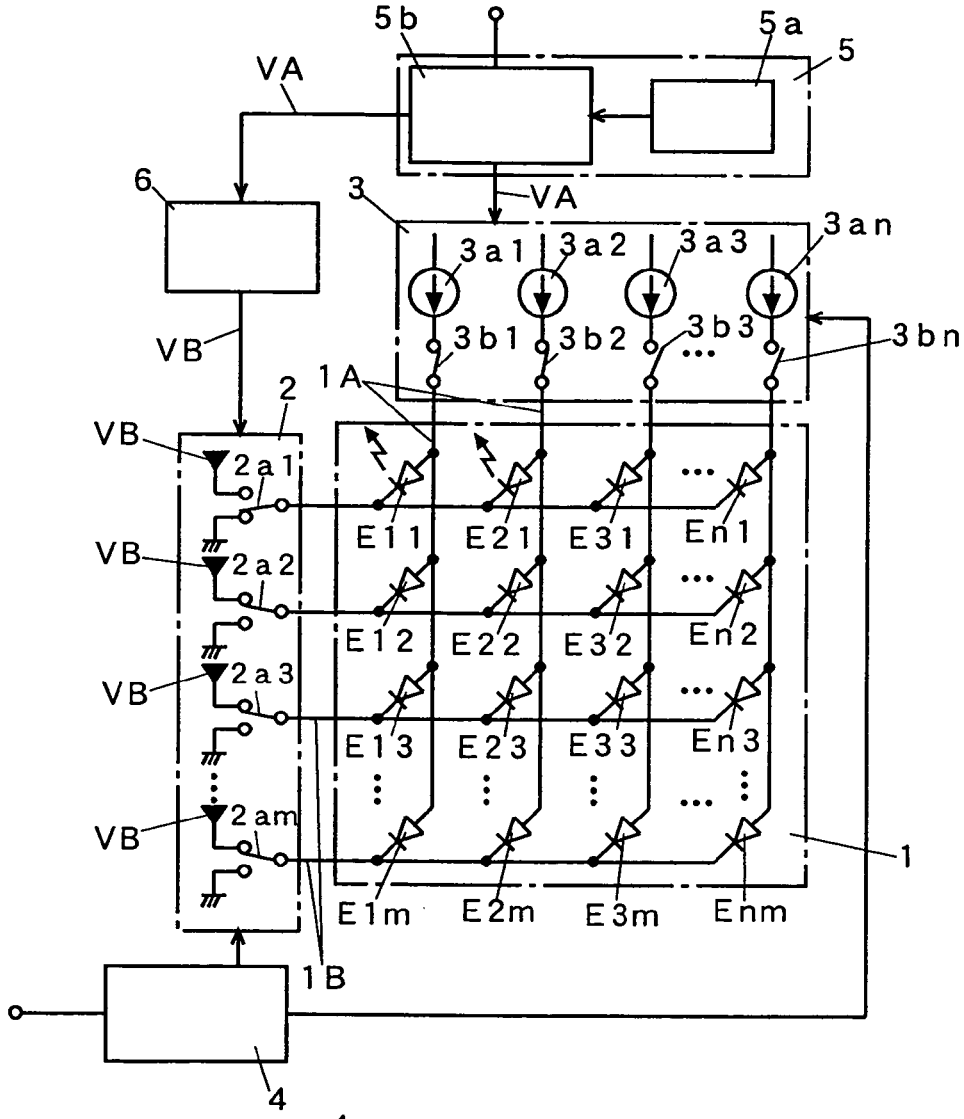
FIG. 1 is a block diagram showing a drive circuit for an organic EL panel of this embodiment.

An embodiment of the present invention will be hereinafter described based upon the accompanying drawings. Parts identical with or equivalent to those in the conventional example are denoted by identical reference numerals, and detailed descriptions of the parts will be omitted.

As shown in FIG. 1, a drive circuit in this embodiment comprises an organic EL panel 1, a cathode side drive circuit 2, an anode side drive circuit 3, a control unit 4, first temperature compensation means 5, and second temperature compensation means 6.

In the organic EL panel 1, plural anode electrode lines (first electrode lines) 1A and cathode electrode lines (second electrode lines) 1B are disposed in which the anode electrode lines 1A and the cathode electrode lines 1B are perpendicular (crossing) with each other, and an organic layer including at least a light-emitting layer is held in these crossing parts to constitute organic light-emitting devices E11 to Enm.

The cathode side drive circuit 2 selects a reverse bias voltage VB, which becomes a power supply voltage on a cathode side and is generated by the second temperature compensation means 6 described in detail later, or a ground potential with scanning switches 2*a*1 to 2*am*.

The anode side drive circuit 3 is provided with constant current sources 3*a*1 to 3*an* for each anode electrode line 1 and selectively applies an output current (constant current) from the constant current sources 3*a*1 to 3*an* to the anode electrode lines 1A via respective drive switches 3*b*1 to 3*bn*.

The control unit 4 outputs a control signal to the cathode side drive circuit 2 and the anode side drive circuit 3, respectively, in an attempt to drive organic EL devices E11 to Enm in the organic EL panel 1, selectively turns ON/OFF the scanning switches 2*a*1 to 2*am* and the drive switches 3*b*1 to 3*bn* of the cathode electrode and anode electrode lines 1B, 1A, and causes the organic EL devices E11 to Enm bearing pixels to emit light to thereby display various kinds of information.

The first temperature compensation means 5 is provided with temperature detection means 5*a* which consists of a thermistor for detecting a change in ambient temperature as a change in resistance value, and a power supply circuit 5*b* which supplies a first temperature compensation voltage (first temperature compensation voltage) VA obtained by fluctuating a drive voltage (power supply voltage) in the first temperature compensation means 5 in accordance with an output in the temperature detection means 5*a*, that is, the change in ambient temperature to the constant current sources 3*a*1 to 3*an*, thereby supplying a constant current to the respective anode electrode lines 1A via the drive switches 3*b*1 to 3*bn*. Note that the power supply circuit 5*b* is a well-known circuit which comprises, for example, a booster circuit for raising an original power supply voltage to obtain a drive voltage, a driver IC, and the like.

Figure 2:
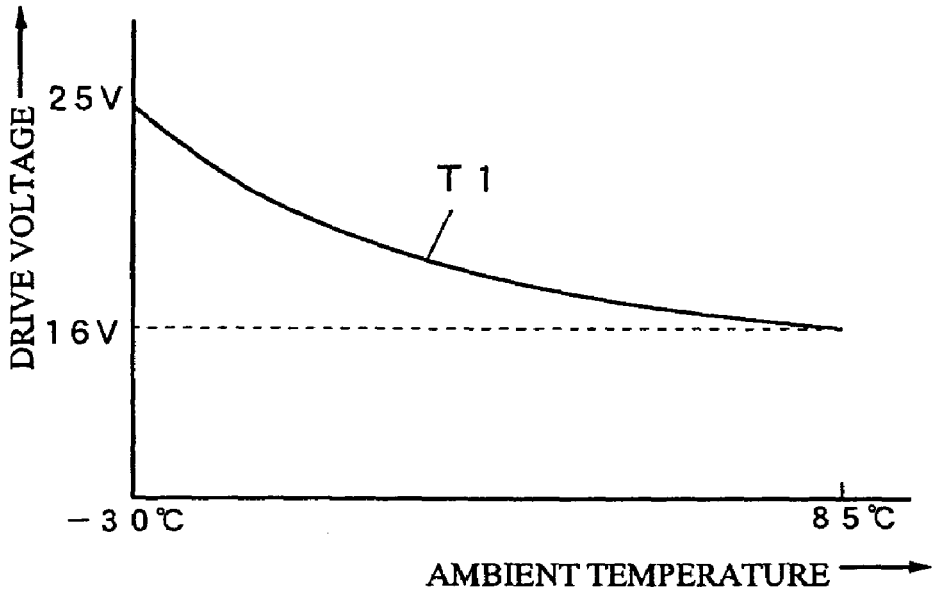
FIG. 2 is a graph showing a temperature voltage characteristic of the organic EL panel of this embodiment.

FIG. 2 shows a first temperature compensation characteristic T1 indicating a relation between the first temperature compensation drive voltage VA, which is supplied from the anode side drive circuit 3 to the organic EL panel 1, and an ambient temperature (−30 degrees Celsius to 85 degrees Celsius). The first temperature compensation means 5 generates the first temperature compensation drive voltage VA following the first temperature compensation characteristic T1 based upon an output from the temperature detection means 5*a*. Note that it is assume that the first temperature compensation drive voltage VA changes, for example, within a range of 25V to 16V according to an ambient temperature.

Figure 3:
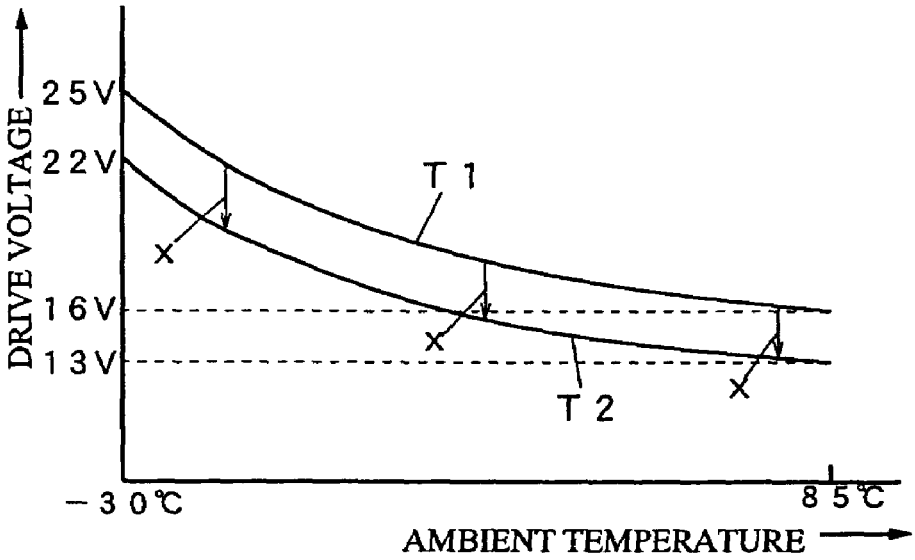
FIG. 3 is a graph showing a temperature voltage characteristic following an offset amount of the organic EL panel of this embodiment.

The second temperature compensation means 6 sets the first temperature compensation voltage VA generated by the first temperature compensation means 5 as a power supply voltage and generates a second temperature compensation voltage VB to be a reverse bias voltage in the cathode side drive circuit 2. That is, as shown in FIG. 3, the second temperature compensation means 6 sets the second temperature compensation voltage VB, which is based upon a second temperature voltage characteristic T2 having a predetermined offset amount x (first temperature compensation drive voltage V—offset voltage) with respect to the first temperature voltage characteristic T1, as a reverse bias voltage (power supply voltage) VB of the cathode side drive circuit 2. Note that, in the case in which the offset amount x is assumed to be, for example, 3V with respect to the first temperature compensation drive voltage VA, when the first temperature compensation drive voltage VA in the first temperature voltage characteristic T1 changes in a range of 25V to 16V, the second temperature compensation drive voltage VB in the second temperature voltage characteristic T2 changes in a range of 22V to 13V.

Figure 4:
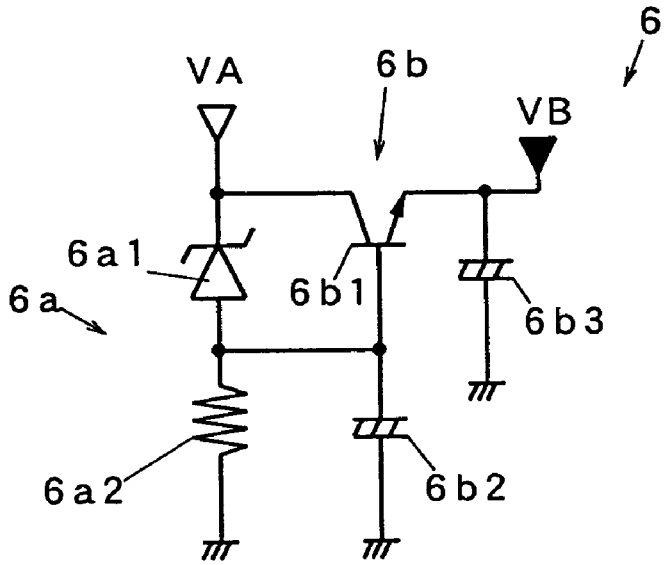
FIG. 4 is a diagram showing second temperature compensation means in the drive circuit of this embodiment.

The second temperature compensation means 6 has a circuit structure as shown in FIG. 4 in order to obtain the second temperature voltage characteristic T2 having the fixed offset amount x with respect to the first temperature voltage characteristic T1. That is, the second temperature compensation means 6 consists of a power supply output section 6*b* having offset means 6*a* in order to obtain the second temperature voltage characteristic T2. The offset means 6*a* consists of a Zener diode 6*a*1 and a resister 6*a*2 connected in series. The power supply output section 6*b* comprises an npn transistor 6*b*1 and electrolytic capacitors 6*b*2, 6*b*3. Therefore, one end side of the offset means 6*a* (cathode side of the Zener diode 6*a*1) is connected to the drive power supply (first temperature compensation drive voltage) VA and the other end side (resister 6*a*2 side) thereof is connected to the ground potential to give a voltage divided by the Zener diode 6*a*1, and the resister 6*a*2 is given as a base voltage of the npn transistor 6*b*1 in the power supply output section 6*b*, whereby the second temperature drive voltage VB having the predetermined offset amount x with respect to the first temperature compensation drive voltage VA is obtained. Note that the offset amount x depends upon the Zener diode 6*a*1 and the resister 6*a*2, and fluctuation occurs in the offset amount x by an amount of loss of reactive power due to heat generation of the Zener diode 6*a*1, the resister 6*a*2, components of the power supply output section 6*b*, or the like. However, if the fluctuation is in a level not affecting a light emission luminance of the organic EL panel 1, the offset amount x is assumed to be a predetermined offset amount x.

Such a drive circuit for the organic EL panel 1 comprises: drive switches 3*b*1 to 3*bn* for selectively applying a constant current to any one of the anode electrode lines 1A; the constant current sources 3*a*1 to 3*an* which supply the constant current to the anode electrode lines 1A, respectively, via the drive switches 3*b*1 to 3*bn*; the scanning switches 2*a*1 to 2*am* for selectively setting any one of the cathode electrode lines 1B to a ground potential and applying the reverse bias voltage VB to the other cathode electrode lines 1B; the first temperature compensation means 5 which is provided with the temperature detection means 5*a* for detecting an ambient temperature of the organic EL devices E11 to Enm, and generates the first temperature compensation drive voltage VA obtained by changing a power supply voltage according to an output from the temperature detection means 5*a* and supplies the first temperature compensation drive voltage VA to the constant current sources 3*a*1 to 3*an*; and the second temperature compensation means 6 which applies the temperature-compensated second temperature compensation drive voltage VB, which is generated based upon the first temperature compensation drive voltage VA outputted from the first temperature compensation means 5, to the cathode electrode lines 1B via the scanning switches 2*a*1 to 2*am*.

That is, the second temperature compensation means 6 generates the second temperature compensation drive voltage VB, which has the predetermined offset amount x with respect to the first temperature compensation drive voltage VA obtained by the first temperature compensation means 5, with the power supply output section 6*b* having the offset means 6*a* which is formed by connecting the Zener diode 6*a*1 and the resister 6*a*2 in series. Therefore, in the cathode side of the organic EL panel 1, since it becomes possible to give the reverse bias voltage (second temperature compensation drive voltage) VB, which becomes a proper drive voltage according to an ambient temperature, to the cathode electrode lines 1B, it becomes possible to suppress generation of a light emission luminance exceeding a predetermined luminance as in the past. Thus, it becomes possible to suppress a change in luminance with respect to temperature change of organic EL devices bearing pixels, and it is possible to obtain satisfactory display on the organic EL panel 1 and marketability can be improved.

In addition, in the anode side, again, since it becomes possible to supply the first temperature compensation drive voltage VA, which becomes an optimal drive voltage according to an ambient temperature, to the constant current sources 3*a*1 to 3*an* in the anode side drive circuit 3, it becomes possible to reduce generation of reactive power of drive devices in the constant current sources 3*a*1 to 3*an* following a change in ambient temperature. Thus, since it becomes possible to suppress harmful influence to the anode side drive circuit 3 by heat generation, durability can be improved.

Figure 5:
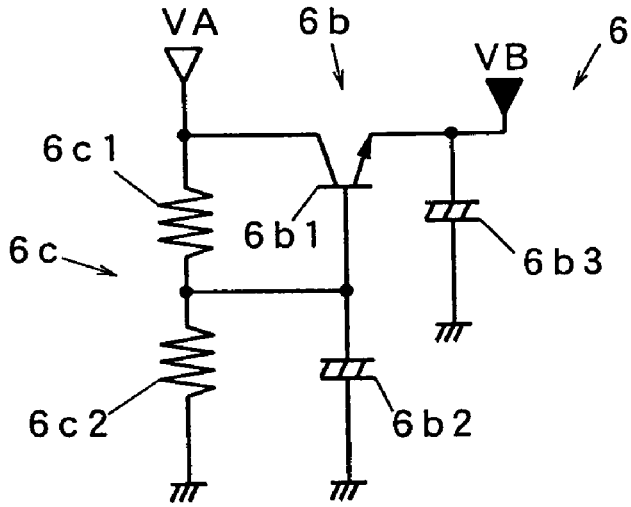
FIG. 5 is a diagram showing another second temperature compensation means of this embodiment.
Figure 6:
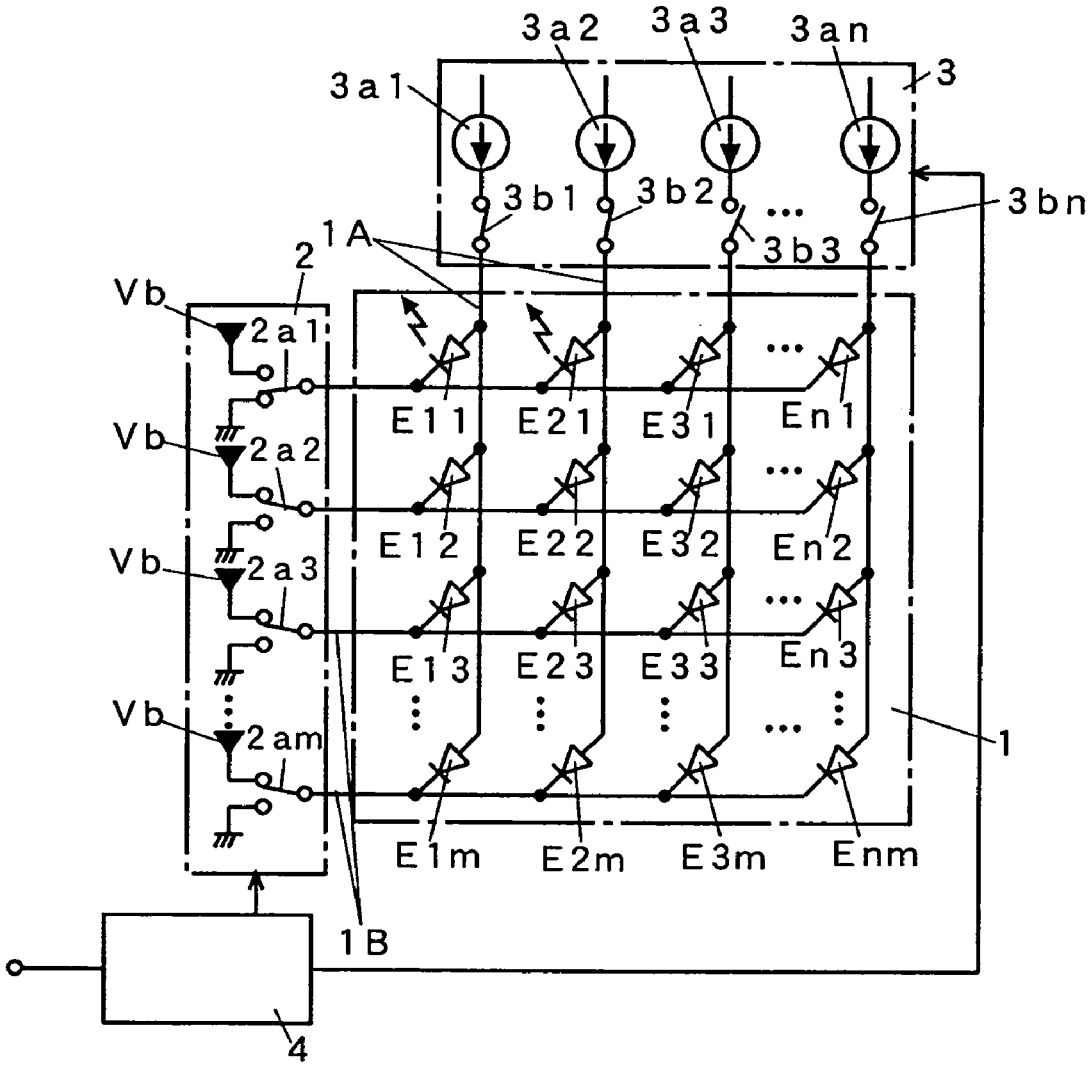
FIG. 6 is a block diagram showing a conventional drive circuit for an organic EL panel.

FIG. 5 shows another embodiment mode in the second temperature compensation means 6. The embodiment mode is different from the above-mentioned embodiment mode in that the second temperature compensation drive voltage (reverse bias voltage) VB is obtained by voltage dividing means 6*c* instead of the offset means 6*a*.

In the second temperature compensation means 6, the respective resisters (at least two resisters) 6*c*1, 6*c*2 are connected in series and, at the same time, the first temperature compensation drive voltage VA is divided by the resister 6*c*1 and the resister 6*c*2, and this voltage obtained by dividing the first temperature compensation drive voltage VA is given as a base voltage of the transistor 6*b*1, whereby the second temperature compensation drive voltage VB divided at a predetermined ratio with respect to the first temperature compensation drive voltage VA is obtained.

In such an embodiment mode, the second temperature compensation means 6 generates the second temperature compensation drive voltage VB divided at a predetermined ratio with respect to the first temperature compensation drive voltage VA obtained by the first temperature compensation means 5 (a second temperature voltage characteristic T2' fallen at a predetermined ratio with respect to the first temperature voltage characteristic T1. In the cathode side of the organic EL panel 1, since it becomes possible to give the reverse bias voltage (second temperature compensation drive voltage) VB, which becomes a proper drive voltage corresponding to an ambient temperature, to the cathode electrode lines 1B, it becomes possible to minimize a change in luminance with respect to temperature change of the organic EL device bearing pixels as in the above-mentioned embodiment mode.

Note that the second temperature compensation drive voltage VB obtained by dividing the first temperature compensation drive voltage VA depends upon the two resisters 6*c*1, 6*c*2, and fluctuation occurs in the second temperature compensation drive voltage VB by an amount of loss of reactive power due to heat generation of the respective resister 6*c*1, 6*c*2, components of the power supply output section 6*b*, or the like. However, if the fluctuation is in a level not affecting a light emission luminance of the organic EL panel 1, it is assumed that the second temperature compensation drive voltage VB is divided at a predetermined ratio.

INDUSTRIAL APPLICABILITY

As described above, the drive circuit for an organic EL panel in accordance with the present invention is a drive circuit which is particularly effective in a display panel provided with an organic EL device of a dot matrix type.

The invention claimed is:

1. A drive circuit for an organic EL panel which is provided with first and second electrode lines, at least one of which is translucent, in a plural form, respectively, and in which an organic layer including at least a light-emitting layer is held between the respective electrode lines to constitute an organic EL devices of a dot matrix shape, characterized by comprising: anode scanning means for selectively applying a constant current to any one of the first electrode lines; a constant current source which supplies the constant current to the first electrode lines, respectively, via the anode scanning means; cathode scanning means for selectively setting any one of the second electrode lines to a ground potential and applying a reverse bias voltage to the other second electrode lines; first temperature compensation means which is provided with temperature detection means for detecting an ambient temperature of the organic EL devices, and generates a first temperature compensation drive voltage obtained by changing a power supply voltage according to an output from the temperature detection means and supplies the first temperature compensation drive voltage to the constant current source; and second temperature compensation means which applies a temperature-compensated second temperature compensation drive voltage, which is generated based upon the first temperature compensation drive voltage outputted from the first temperature compensation means, to the second electrode lines as the reverse bias voltage via the cathode scanning means.

2. A drive circuit for an organic EL panel according to claim 1, characterized in that the second temperature compensation means generates the second temperature compensation drive voltage which has a predetermined offset amount with respect to the first temperature compensation drive voltage obtained by the first temperature compensation means.

3. A drive circuit for an organic EL panel according to claim 2, characterized in that the second temperature compensation means determines the offset amount with offset means which is formed by connecting a Zener diode and a resister in series.

4. A drive circuit for an organic EL panel according to claim 1, characterized in that the second temperature compensation means applies the second temperature compensation voltage of a predetermined ratio with respect to the first temperature compensation drive voltage obtained by the first temperature compensation means to the second electrode lines via the cathode scanning means.

5. A drive circuit for an organic EL panel according to claim 4, characterized in that the second temperature compensation means is provided with voltage dividing means formed by connected at least two registers in series and generates the second temperature compensation drive voltage divided at a predetermined ratio with respect to the first temperature compensation drive voltage by the voltage dividing means.

* * * * *